United States Patent [19]

Buffet

[11] Patent Number: 4,832,582

[45] Date of Patent: May 23, 1989

[54] ELECTRIC DIAPHRAGM PUMP WITH VALVE HOLDING STRUCTURE

[75] Inventor: Jean C. Buffet, Fontvieille, Monaco

[73] Assignee: Eaton Corporation, Cleveland, Ohio

[21] Appl. No.: 178,108

[22] Filed: Apr. 6, 1988

[30] Foreign Application Priority Data

Apr. 8, 1987 [GB] United Kingdom ..... 8708417

[51] Int. Cl.[4] ..... F04B 43/14; F04B 39/10

[52] U.S. Cl. ..... 417/413; 417/566

[58] Field of Search ..... 417/393, 395, 413, 566, 417/571; 137/844, 846, 454.4

[56] References Cited

U.S. PATENT DOCUMENTS

| | | | |
|---|---|---|---|
| 2,898,860 | 8/1959 | Gröber | 417/413 |
| 3,127,846 | 4/1964 | Kerns | 417/566 |
| 3,701,614 | 5/1971 | Guidicelli | 417/413 |
| 3,981,632 | 9/1976 | LeFebre | 417/413 |
| 4,370,107 | 1/1983 | Landis et al. | 417/413 |
| 4,536,139 | 8/1985 | Greco et al. | 417/571 |
| 4,608,000 | 8/1986 | Tominaga | 417/413 |

FOREIGN PATENT DOCUMENTS

| | | | |
|---|---|---|---|
| 585298 | 9/1933 | Fed. Rep. of Germany . | |
| 643086 | 4/1937 | Fed. Rep. of Germany . | |
| 2262711 | 5/1973 | France . | |
| 2485108 | 12/1981 | France . | |
| 440693 | 1/1936 | United Kingdom | 417/413 |

*Primary Examiner*—Leonard E. Smith
*Assistant Examiner*—Robert N. Blackmon
*Attorney, Agent, or Firm*—R. A. Johnston

[57] ABSTRACT

A pump has a solenoid with an armature directly connected to an elastomeric diaphragm. Upon flow of half wave rectified ac current in the solenoid, the armature oscillates the diaphragm. A valve holder has duck-bill type inlet and outlet valves received therein. The valve holder is retained between a valve body and an armature guide member by fastening means which simultaneously effect sealing of the diaphragm rim and the rims of the duck-bill valves. The armature has portions thereof directly engaging a detent recess formed in a central buffer portion of the diaphragm.

5 Claims, 1 Drawing Sheet

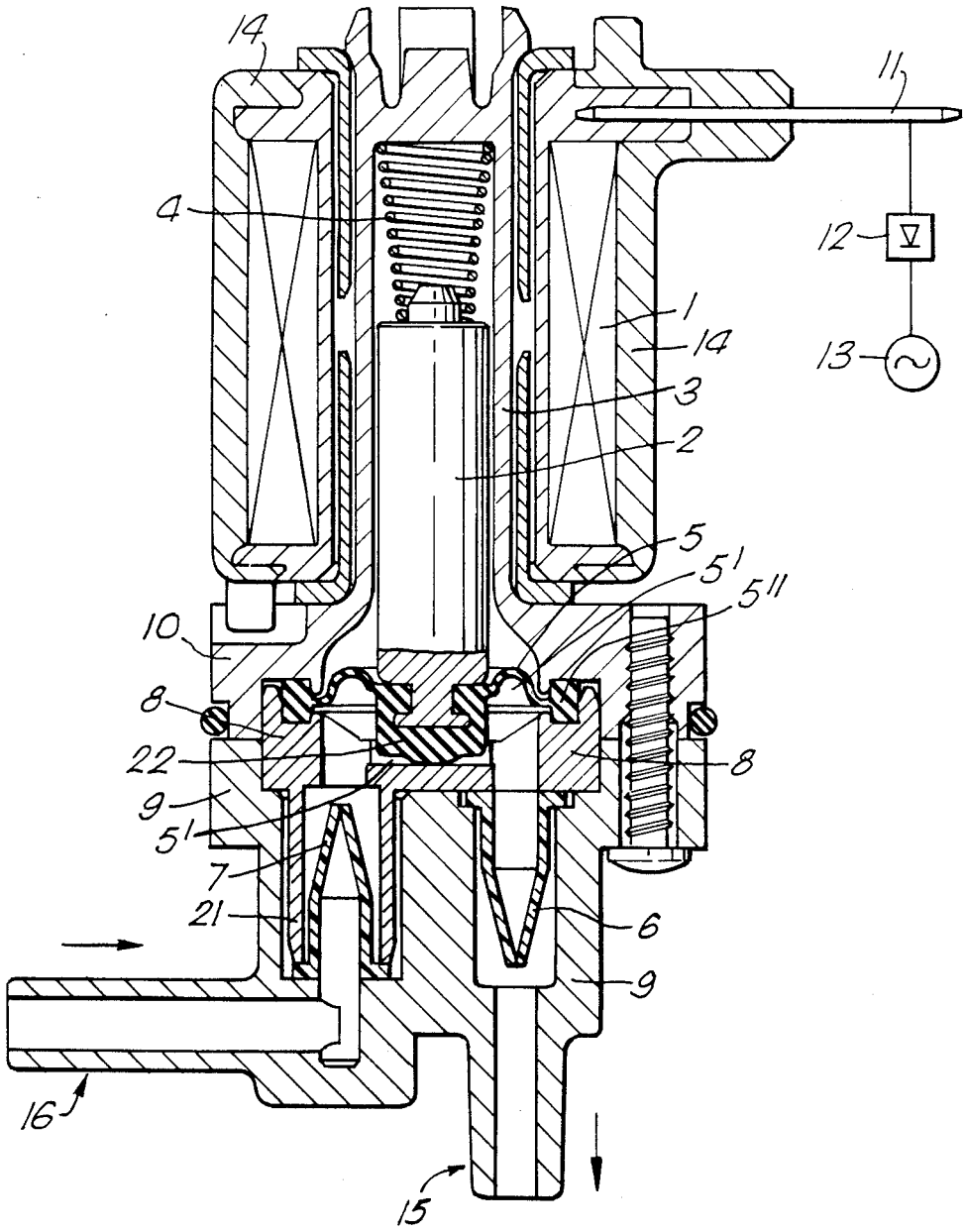
14
11
4
12
1
14
13
3
2
5
5'
5''
10
8
22
8
9
5'
7
21
6
9
16
15

ELECTRIC DIAPHRAGM PUMP WITH VALVE HOLDING STRUCTURE

This invention relates to a pump for fluids, eg hot or boiling water, steam or hot coffee, and aims to provide adequate performance without excess bulk, weight, number of parts or cost price.

Accordingly, the invention features an oscillating armature driven by an alternatingly energized solenoid, a diaphragm oscillated by the armature, and parallel fluidways which each communicate with the diaphragm and contain oppositely directed passive one-way valves, preferably of the type often known as duck bill valves or duck beak valves. The solenoid is intermittently energized by alternating current whereby the diaphragm executes an oscillatory movement. Preferably a return spring biases the armature to a rest position. The energization from the rest position is preferably by means of an ac current through half-wave rectification, eg a single diode. The solenoid can be of the same type as that used for conventional electrically-operated fluid valves, and proposes a very simple assembly and manufacture.

The sole FIGURE of the drawing illustrates further features and advantages, as described below.

Referring to the FIGURE, a solenoid coil 1 drives an armature 2 which can slide up and down in a non-conductive, non-magnetic plastic guide 3 upwards from the rest position shown, against the bias of a return coil spring 4.

Communicating with the space 5' below the diaphragm 5 are two oppositely directed similar duck bill valves 6 and 7 held by a valve holder 8, in which diaphragm 5 can also be secured by its stationary peripheral, strengthened edge 5'. Valve 6 has a bead or rim 6A formed about the inlet end thereof; and rim **6*a* is received in a recess 9*b* formed in the body 9, the recess being sufficiently shallow such that rim 6*a*** is compressed and sealed thereabout upon assembly.

The lower end of the armature may have a forced-on resilient buffer piece 22, which is integral with the central part of the diaphragm 5, to impinge vibratingly on a cental portion of the valve holder 8 in order economically and simply to reduce shocks, wear and noise.

An inlet valve-holder is provided by a conduit extension 21 formed on holder 8 and received in a cavity within valve body 9, and extension 21 actually contains the inlet valve element 7. Valve 7 has a flange or rim 7a formed about the inlet end thereof, which rim is compressed axially upon assembly and sealed thereabout by the end of extension 21 and a cavity formed in the body inlet passage. The valve holder is received in a cavity or recess formed in valve body 9; and, holder 8 is attached by suitable means such as welding or bolting about an annular flange 10 preferably formed integrally with the guide 3. The valve body 9 and the guide 3, thus attached, form the housing for the entire pump, apart from the solenoid and its magnetic circuit. The attaching causes the valves 6, 7 to be clamped, as well as the edge 5''.

Coil 1 is fed at an insulated terminal 11, preferably by an ac source 13 through a single diode 12, or other varying electrical feed. The coil is almost surrounded by a pole frame comprising soft iron or other magnetizable material (not shown) which completes a magnetic circuit with the tubular members 23, 24, which are also magnetizeable and define an air gap 25 therebetween.

When the coil is energized, the armature rises (to decrease the effective magnetic gap) against spring 4. When the coil is next less energized, or preferably de-energized, the armature falls due to return spring 4 lengthening. This up and down movement represents one stroke or cycle of the pump, and will be repeated at 50 Hz (or other supply frequency). The coil is encapsulated with insulated jacketing 14.

The consequent up movement of diaphragm 5 each cycle creates a sub-atmospheric "vacuum" in space 5', which closes valve 6 by forcing the edges of a rubber slit sealingly together. On the other hand, similar valve element 7 is opened by the vacuum, thereby communicating the vacuum with a low pressure port 16. Similarly, each down movement of the diaphragm increases pressure at 5' which opens valve element 6 and pushes fluid to a high pressure port 15. Therefore pressure is raised at 15 and lowered at 16, to create the pumping action which is economically provided by this invention.

The valves 6 and 7 only move by flexures in the vicinity of their resilient slits at the end of tapering cross-sections, and so consume little energy opening or shutting. Moreover, quite small pressure differences can open or close the slits. However, other types of one-way passive valves may be preferred for some purposes.

I claim:

1. An electromagnetically driven pump comprising:

(a) a pump body having a fluid inlet, a pumping chamber including a wall portion thereof formed of a flexible diaphragm and a fluid outlet communicating with said chamber;

(b) one-way inlet valve means disposed in said inlet, said inlet valve formed of elastomeric material with an annular bead formed about the rim of the inlet thereof;

(c) one-way outlet valve means formed of elastomeric material with an annular bead rim and disposed in said outlet;

(d) valve holder means received in said pumping chamber, said valve holder having a tubular extension thereon with said inlet valve received thereon, said holder, upon being clamped against said body simultaneously compressing the respective bead rims of said inlet and outlet valve means for sealing same thereabout;

(e) armature guide means received on said body, said guide means, upon being clamped to said body, operably to effect sealing about said diaphragm, and the bead rims of said inlet and outlet valve means;

(f) armature means movably received in said guide means and operably connected to effect movement of said diaphragm;

(g) fastening means engaging said guide means and operably to clamp said guide means onto said body and to effect sealing about said diaphragm and said bead rims;

(h) electromagnetic means, received over said guide means and operable, upon periodic electrical excitation, to oscillate said armature for effecting pumping of fluid from said inlet, through said chamber to said outlet.

2. The pump defined in claim 1, wherein said bead rims are sealed between said holder means and said body, and said diaphragm is sealed between said holder means and said guide means.

3. The pump defined in claim 1, wherein said electromagnetic means includes a pair of tubular pole pieces received over said guide means and defining an air gap therebetween; and, a solenoid coil received over said pole pieces.

4. The pump defined in claim 1, wherein said guide means includes detent means integrally formed therewith and operable for retaining said electromagnetic means thereon.

5. The pump defined in claim 1, wherein said diaphragm has a buffer portion with a recess formed centrally therein, and said armature means has surfaces thereon engaging said recess for operative connection therebetween.

* * * * *

UNITED STATES PATENT AND TRADEMARK OFFICE

CERTIFICATE OF CORRECTION

PATENT NO. : 4,832,582

DATED : May 23, 1989

INVENTOR(S) : Jean C. Buffet

It is certified that error appears in the above-identified patent and that said Letters Patent is hereby corrected as shown below:

On the title page, assignee should read:

--(73) Assignee: Eaton S.A.M., Monaco--.

Signed and Sealed this

Twentieth Day of February, 1990

*Attest:*

JEFFREY M. SAMUELS

*Attesting Officer*

*Acting Commissioner of Patents and Trademarks*